US007174697B2

(12) United States Patent
Hada et al.

(10) Patent No.: US 7,174,697 B2
(45) Date of Patent: Feb. 13, 2007

(54) SYSTEM AND PROCESS FOR PACKAGING PRODUCTS

(75) Inventors: Frank S. Hada, Appleton, WI (US); Brian J. Gingras, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 11/017,630

(22) Filed: Dec. 20, 2004

(65) Prior Publication Data

US 2006/0130435 A1 Jun. 22, 2006

(51) Int. Cl.

| | |
|---|---|
| ***B65B 9/00*** | (2006.01) |
| ***B65B 51/26*** | (2006.01) |
| ***B65B 49/08*** | (2006.01) |
| ***B65B 11/00*** | (2006.01) |

(52) U.S. Cl. ..... 53/450; 53/462; 53/141; 53/547; 53/550; 53/208; 53/389.3

(58) Field of Classification Search ..... 53/450, 53/141, 389.3, 547, 550, 462, 208
See application file for complete search history.

(56) References Cited

U.S. PATENT DOCUMENTS

| | | | | |
|---|---|---|---|---|
| 1,711,228 A | * | 4/1929 | Duvall et al. | 53/526 |
| 2,276,282 A | | 3/1942 | Bindszus | |
| 3,168,016 A | * | 2/1965 | Kehr | 53/450 |
| 4,430,844 A | | 2/1984 | James | |
| 4,785,696 A | * | 11/1988 | Martiny | 83/152 |
| 4,956,963 A | * | 9/1990 | Johnson | 53/442 |
| 5,014,489 A | | 5/1991 | Terminella et al. | |
| 5,050,368 A | * | 9/1991 | Noh | 53/442 |
| 5,195,300 A | | 3/1993 | Kovacs et al. | |
| 5,442,897 A | * | 8/1995 | Hinzmann et al. | 53/449 |

FOREIGN PATENT DOCUMENTS

| | | | |
|---|---|---|---|
| EP | 0043171 A1 | | 1/1982 |
| GB | 2227473 A | * | 8/1990 |

OTHER PUBLICATIONS

Search Report and Written Opinion for PCT/US2005/025445, Nov. 2, 2005.

* cited by examiner

*Primary Examiner*—Stephen F. Gerrity
(74) *Attorney, Agent, or Firm*—Dority & Manning, P.A.

(57) ABSTRACT

A system and process for packaging groups of products, such as spirally wound paper products are disclosed. During the packaging of groups, a continuous supply of a wrapping material is unwound and cut periodically in the edge regions. Optionally, a perforation line may also be formed into the wrapping material in between the two cut edges. The cut edges form flaps that are then wrapped around the product groups and sealed. The wrapping material is then broken along the perforation lines in order to form individual packages. Finally, the ends of the packages are folded and sealed.

51 Claims, 4 Drawing Sheets

SYSTEM AND PROCESS FOR PACKAGING PRODUCTS

BACKGROUND OF THE INVENTION

Many tissue products, such as toilet paper and paper towels, are typically formed into large supply rolls after being manufactured. After the supply rolls are formed, the rolls are rewound into smaller sized rolls, which are generally more useful for commercial purposes. For example, in many conventional processes, the tissue is wound onto a hollow cylindrical core made of paper stock during a winding and converting operation.

Once formed into smaller rolls, the rolls of material are typically fed to a packaging line and wrapped in groups such as by being encased in a plastic film. The wrapped groups are then placed in boxes and shipped to customers.

Current wrapping machines are of two primary styles, reciprocating single sheet feeding wrappers and continuous flow wrappers. Reciprocating wrappers cut individual sheets of plastic film, feed the film into a machine, and push the product through the sheet to cover three sides of the product. The package is first sealed into a tube and the sides of the package are then sealed by heated belts. Reciprocating wrappers are capable of automatically adjusting to rolled products that may vary in size and in firmness because it is the contents of the package that determine the tightness of the wrap. Reciprocating wrappers, however, are prone to mechanical wear from the constant traversing load that is placed on key components and because of the reciprocating motion, generally run at lower operating speeds.

Continuous motion wrappers, on the other hand, may include an in-feed conveyor and a sorter for placing the rolls of material into groups of a desired size. The groups are then fed to a forming shoulder where the groups are placed in a tube formed from a plastic packaging film. The forming shoulder is configured to change a flat sheet of continuous film into a continuous tube sized to the product. The forming shoulder, however, is typically sized for only one combination of roll diameter and firmness. Products that have a lower firmness value may result in a loose pack while products that have high firmness values can cause machine jam-ups. Continuous flow wrappers, in comparison to reciprocating wrappers, are mechanically simpler, are less prone to wear, and, in some embodiments, may run at higher speeds. More recently, continuous flow wrappers that can handle more than one layer of product has further increased their versatility. One embodiment of a continuous motion wrapper, for example, is described in U.S. Pat. No. 5,195,300, which is incorporated herein by reference.

In view of the above, however, a need remains for an improved wrapping apparatus that combines the advantages of reciprocating wrappers with the advantages of continuous motion wrappers. Specifically, a need exists for a wrapping apparatus capable of operating at high speeds that is mechanically simple and does not place a tremendous amount of stress on the packaging material as the material is wrapped around the product and does not require a fixed forming shoulder to form the wrapping material around the package. Also, an added advantage is a wrapper with these features that permits the use of recycled, low caliper wrapping material or paper as the wrapping medium.

SUMMARY OF THE INVENTION

In general, the present disclosure is directed to an improved system and process for packaging products, such as rolls of material. In accordance with the present invention, a continuous wrapping material is unwound, severed along opposing edges, and perforated in a center region. The cut edges allow wrapping of the product without strain on the wrapping material. The system of the present invention is particularly well suited to replacing the forming shoulder in conventional continuous motion wrappers.

In one particular embodiment, for instance, the system for packaging products includes a conveyor for conveying a product separated into groups. An unwind device unwinds a wrapping material adjacent to a first surface of the product groups that are being conveyed on the conveyor. The wrapping material includes first flaps that are positioned along a first edge region and second flaps that are positioned along a second edge region. The wrapping material optionally further comprises perforation lines located in a middle region of the wrapping material. In one particular embodiment, for instance, a cutting and perforating device severs the edges of the material as the material is being unwound while simultaneously perforating the middle region of the material.

A pair of opposing folding devices, such as a plurality of folding dies, are positioned adjacent each side of the product groups. The folding devices are configured to engage the first and second flaps and fold them over the sides of the groups. The flaps are further folded over a second surface of the groups that is opposite the first surface. Once the wrapping material is completely surrounding the package a heating device is used to seal the product around the package. If paper is used as the wrapping medium, glue is applied or activated to complete the sealing process. Note that it is possible to pre-apply a hot melt adhesive to the paper film and activate it using the same heating mechanism as that used for polyethylene film.

After the first and second flaps have been folded, a perforation breaking device severs the wrapping material along the perforation lines thus separating the groups into individual packages. The direction of movement is altered by ninety degrees to the initial wrapping direction to allow a second and third sealing device to seal a front end and a back end of the package where the perforation lines have been severed.

In one embodiment, the wrapping material is unwound above a top surface of the product groups. In this embodiment, the first and second flaps are folded around the side surfaces and over a bottom surface of the groups. Prior to being folded, the first and second flaps may be held above the groups by at least one suction device. The at least one suction device, for instance, may comprise a plurality of vacuum belts.

The folding devices that are used to fold the flaps may comprise a plurality of folding dies. For example, in one embodiment, a pair of opposing folding dies may initially engage the flaps and fold them over the side surfaces of the groups. Next, a third folding die positioned adjacent to a bottom surface of the groups may engage the flaps for folding the flaps over the bottom surface. In this embodiment, the groups may be supported by a pair of opposing side conveyors while the flaps are being folded and sealed together. The folding dies may also include vacuum belts to continue to pull the wrapping material tightly around the product groups. A feature of the wrapping section is the ability to adjust to the width of the package either with feed forward sensing of the width of the packages, adjustment to a set pressure or to a static width which is kept constant for all packages.

In addition to a system for packaging products, the present invention is also directed to a process for packaging product groups in a wrapping material. The process may include the steps of conveying a product separated into groups down a process line while unwinding a continuous wrapping material. The wrapping material may include opposing flaps and a plurality of perpendicular perforation lines spaced along the length of the material.

While the product groups are being conveyed down the process line, a first surface, such as the top surface, of each group may be placed adjacent to the wrapping material in between the perforation lines. The first flaps and the second flaps are then folded over the groups. Specifically, the flaps are folded over the sides of the groups and over a bottom surface of the groups and sealed together. The wrapping material is then severed along the perforation lines in order to separate the groups into individual packages. The packages are then sealed along a front end and along a back end where the perforation lines have been severed. Usually this final sealing step requires that the package direction be changed by ninety degrees to expose the unsealed ends of the packages to the heat sealing mechanism.

The system and process of the present invention are particularly well suited to packaging rolled materials. Of particular advantage, a relatively low amount of strain and stress is placed on the wrapping material as the material is placed around the groups. Thus, weaker wrapping materials may be used to construct the packages. The wrapping material may comprise, for instance, a relatively thin plastic film, a paper product, or a film that contains recycled materials.

Other features and aspects of the present invention are discussed in greater detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

Figure 1:
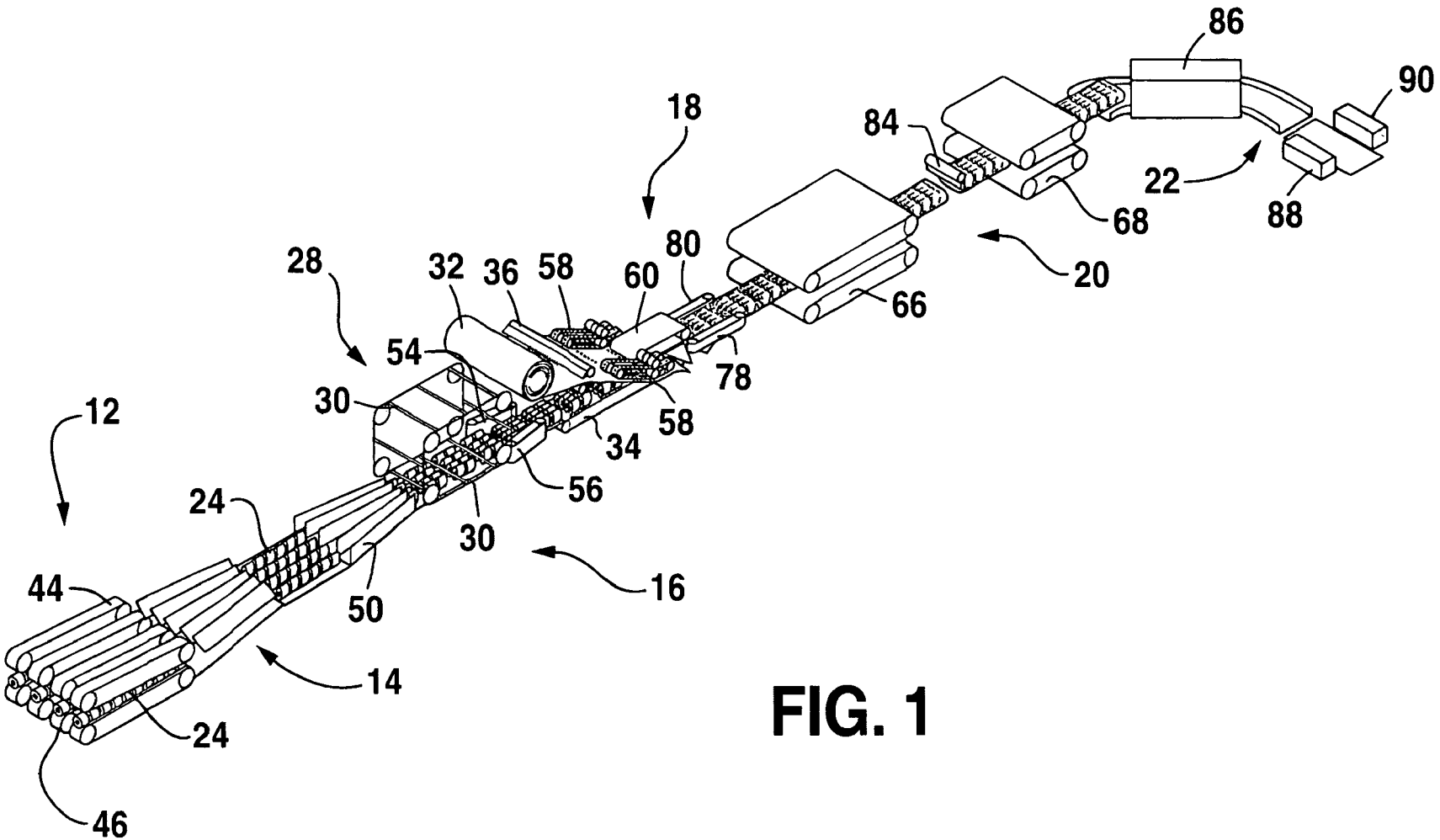
FIG. 1 is a perspective view of one embodiment of a system for packaging rolls of material made in accordance with the present invention.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present invention.

In general, the present invention is directed to a process and system for packaging products. For instance, the system and process of the present invention are particularly well suited to packaging rolls of material, such as spirally wound paper products. The wound products may include, for example, bath tissues, paper towels, wet wipes, industrial wipers, and the like. It is to be understood that this method of wrapping can also be used for the wrapping of a multitude of goods where plastic or paper wrapping is required.

In one embodiment, the products are fed to a processing line and separated into groups. Each group may contain a single product or may contain a plurality of products. As the groups are conveyed down a conveyor, a continuous supply of wrapping material is placed on a first surface of the product groups. The packaging material contains flaps which are then folded around the sides and over a second surface of the groups. The first surface, for example, may be a top surface while the second surface may be a bottom surface. After the flaps are folded and sealed, a perforation line formed into the wrapping material is broken in order to separate the groups into individual packages. Finally, the front and back ends of the packages where the perforation lines have been severed are sealed.

The process and system of the present invention provide various advantages and benefits. For example, since the groups of products are packaged from a continuous supply of wrapping material instead of from individual sheets, the packaging apparatus is capable of operating at relatively high speeds. Further, due to the formation of the flaps and the perforation lines, the wrapping material may form around each group of products without being subjected to any significant stress or strain. Thus, there is less likelihood that the wrapping material will break during formation of the packages. Further, since less strain, such as less than about 50%, is placed on the packaging material, the process and system is capable of using lower strength materials to package the products. For instance, the products may be packaged in a paper wrapper, in a plastic film having a relatively low caliper, such as less than about 0.5 mils or less than about 0.010". and/or in a plastic film containing recycled materials.

Another advantage to the process and system of the present invention is that the wrapping material is wrapped around the groups of product by, in one embodiment, a plurality of stationary folding dies. Since the folding dies are stationary, the system is not prone to mechanical wear. It is recognized that some assistance may be required to ensure that the flaps are completely folded around the product groups before heat sealing the film.

Still another benefit of the present invention is that the system is capable of accommodating product groups that may vary in size and firmness. Specifically, since the wrapping material is wrapped around the product groups without being subjected to relatively high amounts of stress and strain, the wrapping material is less likely to break or tear and product jam-ups are less likely to occur even if the size and/or firmness of the products vary over time.

Although the principles of the present invention may be incorporated into any suitable packaging or bundling process line, one exemplary illustration of a packaging line is shown in FIG. 1. The embodiment shown in FIG. 1 is particularly directed to packaging a spirally wound product 24, such as bathroom tissue or paper towels. As the rolls of material 24 are packaged, in this embodiment, the rolls are compressed in order to minimize as much dead space as possible in an effort to lower shipping costs.

As illustrated, the process line includes an in-feed section 12 that is used to meter the rolls 24 into the wrapping machine. Next, the processing line includes an optional roll turning section 14 where the rolls are rotated 90 degrees about their longitudinal axis to a vertical orientation in order to reduce the width of the columns of rolled product as the product is further conveyed down the line. Once oriented, the rolled products then enter a roll alignment and grouping section 16. Here, the columns of product are separated into the desired groupings. Not shown is the ability to stack the groups into two layers for packages with a higher count of roll. As used herein, a group may refer to only a single product or to a plurality of products.

After being grouped, the rolls of material 24 are then fed to a packaging apparatus 18 in accordance with the present invention where the groups of rolls are wrapped in a packaging material, such as a flexible plastic film or a paper. Once packaged, the groups are then conveyed to a sealing section 22 where the ends of the packages are sealed. Once sealed, the packages may then be loaded into boxes for shipping to a desired site.

Describing each section in more detail, as shown in FIG. 1, the in-feed section 12 in this embodiment comprises a top conveyor 44 and a bottom conveyor 46. The conveyors 44 and 46 are paired, with one pair of conveyors being provided for each line of product rolls introduced into the process line. The in-feed section 12 as shown in FIG. 1 is also referred to as a choke belt assembly. In the embodiment illustrated, the in-feed section 12 includes four pairs of conveyors 44 and 46. It should be understood, however, that a greater or lesser number of conveyors may be used.

In one embodiment, as the rolls of material 24 are fed to the process line, the conveyors 44 and 46 apply compression to the rolls so as to at least partially collapse the hollow core contained with the rolls. In other embodiments, however, it may be desirable not to compress the rolls of material but simply to use the in-feed section as a means for feeding the rolled products into the processing line in an organized manner.

From the in-feed section 12, the rolls of material 24 are optionally rotated 90 degrees in the roll turning section 14 and then fed to the roll alignment and grouping section 16. In the roll turning section 14, as shown in FIG. 1, the rolls of material 24 are rotated 90 degrees while being engaged by a plurality of side rails 50.

The roll alignment and grouping section 16 includes a pair of opposing side conveyors 54 and 56. The side conveyors 54 and 56 may further compact the rolls prior to being placed in a wrapping material. In an alternative embodiment, instead of using side conveyors, the system may include side rails for guiding the products.

In order to separate the rolls of material 24 into groups, the system may further include a flight bar device 28. The flight bar device 28, for example, may be positioned above the product groups and may include a plurality of flight bars 30 that are selectively placed in between adjacent rows of products for separating the products into groups and to take up the air gap between individual rolls of product. For example, as shown in FIG. 1, in one embodiment, the products are accelerated onto a stationary surface. The flight bars 30, however, are contained in a moving conveyor that engages the product groups and pushes them forward until the product groups are further conveyed by a pair of moving side conveyors 54 and 56. As shown, the flight bar device 28, in this embodiment, comprises an endless conveyor containing a plurality of flight bars 30. Each of the flight bars 30 are connected at opposite ends to the conveyor which constantly circulates the flight bars in a revolving fashion. It should be understood, however, that any suitable flight bar device capable of separating the products into groups and removing the gap between individual products may be incorporated into the packaging line shown in FIG. 1.

Figures 2A, 2B:
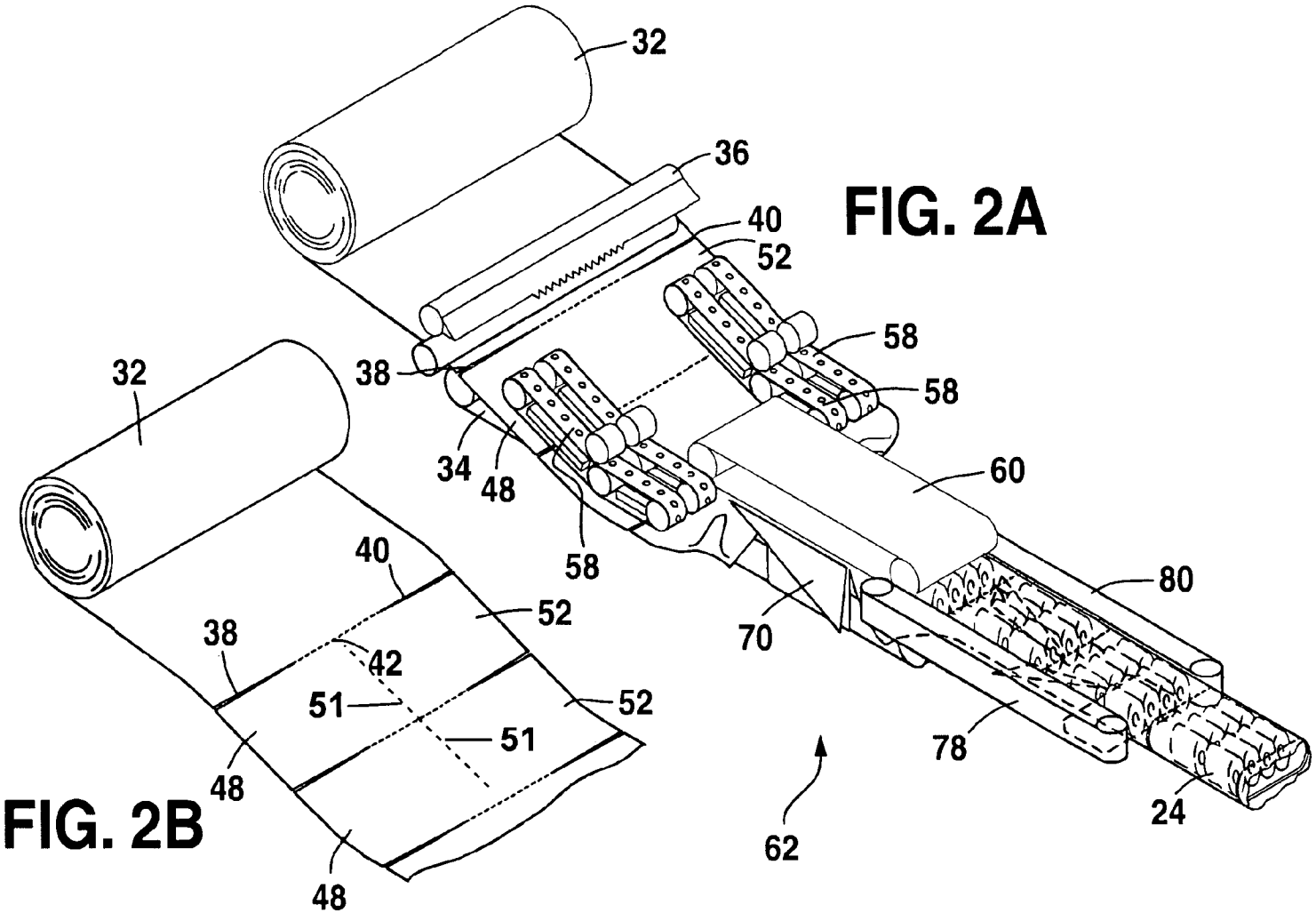
FIG. 2A is a perspective view of one embodiment of a packaging apparatus that may be used in the system shown in FIG. 1.
FIG. 2B is a perspective view of one embodiment of a continuous supply of a wrapping material that may be used to wrap packages in accordance with the present invention.
Figure 3:
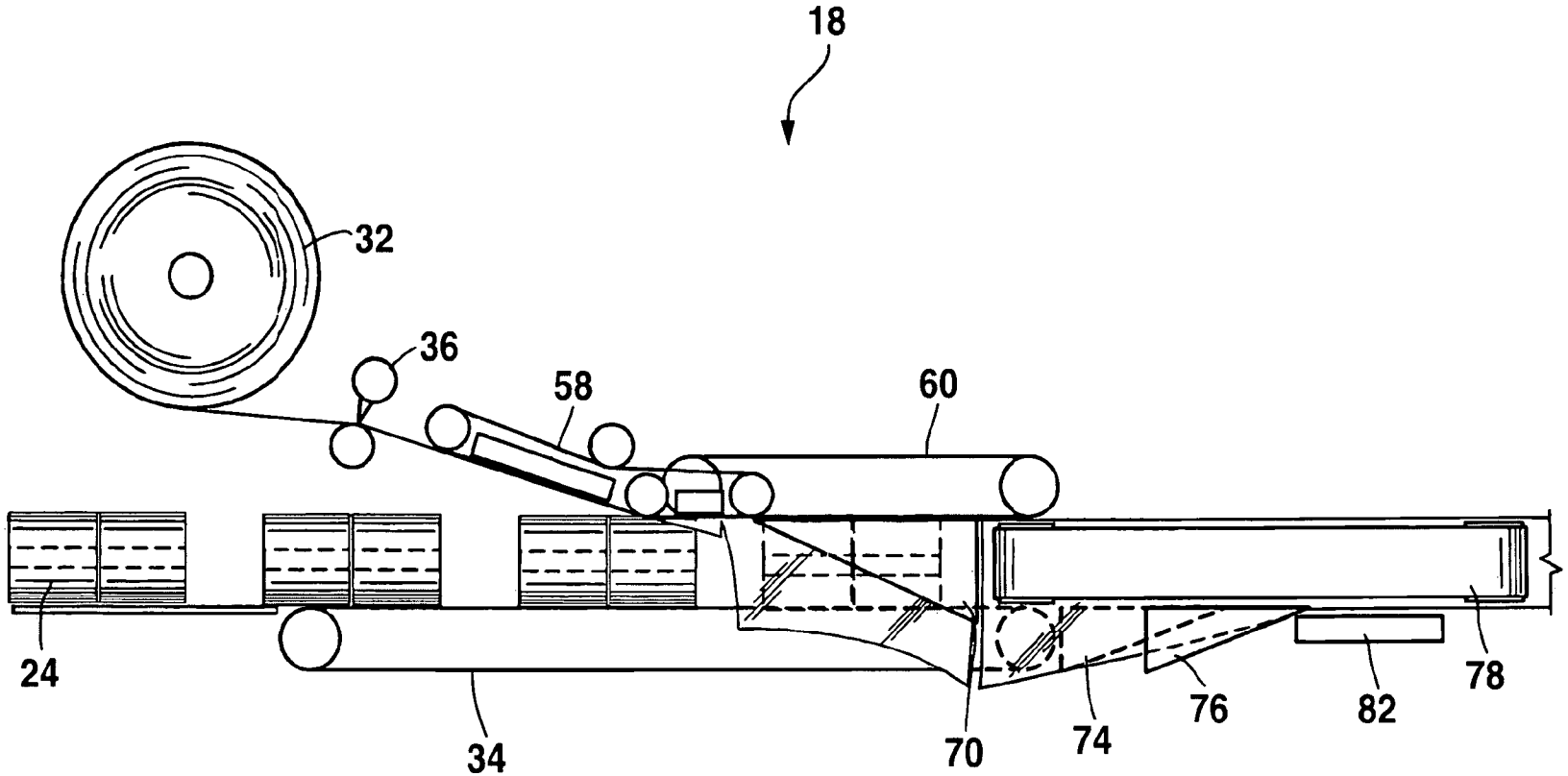
FIG. 3 is a side view of the packaging apparatus illustrated in FIG. 2A.
Figure 4:
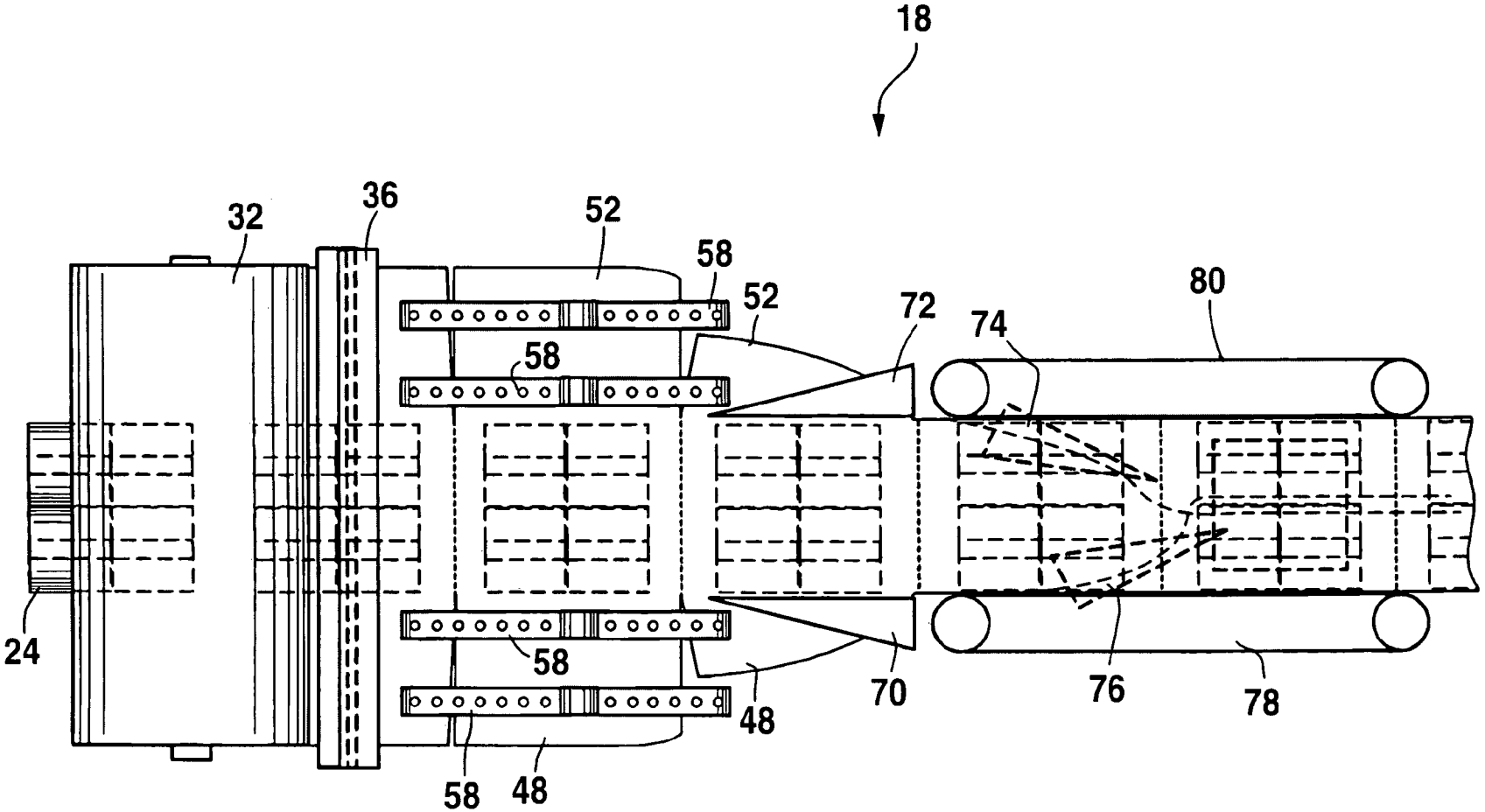
FIG. 4 is a plan view of the packaging apparatus illustrated in FIG. 2A.

Once exiting the roll alignment and grouping section 16, the rolls of material now in groups enter the packaging apparatus 18 of the present invention, which is also shown in FIGS. 2A, 3 and 4. As shown particularly in FIGS. 2A, 3 and 4, the packaging apparatus 18 includes a roll unwind device (not shown) for unwinding a roll of wrapping material 32. The wrapping material 32 may be, for instance, a plastic film, a paper such as a coated paper, or other similar material. As shown in FIG. 1, the wrapping material, in one embodiment, may be unwound above the groups of products as they are conveyed by a conveyor 34. In other embodiments, however, the wrapping material may be unwound below the product groups. As another embodiment the roll of wrapping material may be located away from the central axis of the wrapping section with additional bars to turn the wrapping material 90 degrees into the axis of the wrapping section. This may be desired to facilitate the changing of rolls of wrapping material.

As the wrapping material 32 is unwound, the material is engaged by a cutting and perforation device 36. As shown in FIGS. 2A and 2B, the cutting and perforation device 36 periodically forms a first transverse slit 38 in a first edge region of the material and a second transverse slit 40 in a second edge region of the material. In one embodiment, the cutting and perforation device 36 may also form a perforation line 42 that is positioned in between the first transverse slit 38 and the second transverse slit 40. As shown in the figures, the first transverse slit 38 and the second transverse slit 40 may comprise continuous slits. In other embodiments, however, the first transverse slit and the second transverse slit may have uncut portions along the slits. The uncut portions may provide stability to the wrapping material during later operations while easily breaking apart to provide continuous slits when needed.

By periodically severing the wrapping material 32, lateral flaps are formed in the wrapping material. For example, as shown in FIG. 2B, the transverse slits form first flaps 48 and second flaps 52 in the edge regions of the wrapping material 32. As will be described in greater detail below, the first flaps 48 and the second flaps 52 should have a length sufficient to wrap around the sides of the product groups and be capable of being sealed together along a bottom surface of the product groups. In general, the perforation lines 42 should have a length that is less than the width of the product groups, or more specifically extend between the centerlines of the outermost rolls of the group of rolls for rolls traveling in the direction of the axis of the cores. For a single line of product, the length of the perforation should be about one half the width of the diameter of the roll. If upended or square product is to be wrapped, the perforated section should extend from the outside corner to the outside corner of the product. For example, the perforation line 42 may be at least about one-third of the width of the product groups.

In the embodiments shown in the figures, the cutting and perforation device 36 forms the slits 38 and 40 into the wrapping material 32 as the material is unwound. In other embodiments, however, the wrapping material 32 may already contain the slits 38 and 40 and the perforation line 42. For example, the slits 38 and 40 and the perforation line 42 may be formed into the wrapping material as the wrapping material is formed and wound into a roll.

After the first flaps 48 and the second flaps 52 are formed, in order to keep the flaps above the product groups, the flaps are engaged by a suction device such as by a plurality of vacuum belts 58. While the flaps are being held above the product groups, the product groups being conveyed on the conveyor 34 merge with the wrapping material 32. Specifically, the process is controlled such that each product group becomes positioned in between adjacent perforation lines 42. Further, if various graphics are contained on the wrapping material 32, the cut and perforation step is registered with the graphics on the material and the location of the groups in order to maintain the graphics in alignment with the product.

The slits 38 and 40 formed into the wrapping material may, in one embodiment, include uncut portions to assist the vacuum belts 58 in holding the flaps above the product groups. For instance, the slits may have a single uncut portion or the slits may comprise perforation lines. The uncut portions or perforations may later be severed as the flaps are folded around the product groups by the strain put on the wrapping material during the wrapping process.

As a product group on conveyor 34 merges with the wrapping material 32, the flaps 48 and 52 are wrapped around the groups. In particular, in the embodiments shown in the figures, a retaining belt 60 places and holds the wrapping material 32 on a top surface of the product groups. At least one folding device generally 62 is then used to wrap the flaps 48 and 52 over the sides of the product groups and around the bottom surface of the groups. The folding device 62 may comprise, for instance, any suitable device capable of engaging the flaps and folding them in the desired manner. For example, in one embodiment, the folding device 62 may comprise one or more stationary folding dies that are positioned to receive the flaps 48 and 52.

In one embodiment, as shown particularly in FIG. 4, the system may include a first folding die 70, a second folding die 72, a third folding die 74 and a fourth folding die 76. As shown in FIG. 4, the folding dies 70 and 72 first fold the flaps 48 and 52 down around the sides of the product group. The folding dies 74 and 76 are then used to wrap the flaps around a bottom surface of the groups. After the flaps are folded over the bottom surface of the product groups, as shown in FIG. 3, the flaps are then sealed together by a sealing device 82. The sealing device 82 may, for instance, use heated air to seal the flaps or may apply an adhesive for attaching the flaps together.

As shown in FIGS. 2A, 3 and 4, in order to fold the flaps 48 and 52 around the bottom surface of the groups, the system may include a pair of opposing side conveyors 78 and 80. In particular, the groups exit the conveyor 34 and then are held suspended by the side conveyors 78 and 80. While held by the side conveyors 78 and 80, the flaps 48 and 52 may be folded over the bottom surface of the groups and sealed together.

At this point in the process, the wrapping material 32 is in the form of a tube wrapped around each of the product groups. In order to separate the tube formed from the wrapping material into individual packages, the system further includes a separating section generally 20 as shown in FIG. 1. The separating section 20 includes a first pair of conveyors 66 and a second pair of conveyors 68 spaced downstream from the first pair of conveyors. The product groups are held in between the first pair of conveyors 66 and in between the second pair of conveyors 68 as they are conveyed downstream. In order to separate the packages where the perforations have been made, the second pair of conveyors 68 may operate at a faster speed than the first pair of conveyors 66. For example, the second pair of conveyors 68 may run from about 20% to about 40% faster than the first pair of conveyors 66, such as from about 25% to about 35% faster. Further, the system may include a perforation breaking device 84. The perforation breaking device 84 is for initiating and facilitating separation of the packages along the perforation lines as the packages are being pulled apart by the conveyor 66 and the conveyor 68.

The perforation breaking device 84, in one embodiment, may comprise a rotating plate that strikes the perforation lines in order to initiate the breaking process. It should be understood, however, that any suitable device capable of weakening the wrapping material along the perforation line may be used. Perforating breaking devices can operate singly or in pairs, or be phased such that one perforating device contact the perforation before another one.

In still another embodiment of the present invention, however, the wrapping material may not include the perforation lines 42. Instead, a cutting device may be used to cut the wrapping material where the perforation breaking device 84 is located. The cutting device may be used alone to sever the product groups into individual packages or may work in conjunction with the conveyor 66 and the conveyor 68. A suitable cutting device would be a rotating or sliding serrated blade.

As the packages exit the conveyor 68, the packages flow through an angled section 86. The purpose of the angled section is to change the direction of the packages and to rotate the packages 90 degrees so that the open ends of the packages are perpendicular to the direction of flow. Any suitable apparatus may be used in order to change the direction and rotate the packages.

Finally, the packages enter the sealing section 22. In the sealing section 22, the open ends of the packages are folded and sealed by a pair of sealing devices 88 and 90. The packages may be folded and heat sealed or alternatively an adhesive may be used in order to seal the ends.

Once the packages are sealed, the packages may be placed in boxes and shipped to a location as desired for further sale or consumer use.

Thus, as described above, the wrapping material 32 is cut and perforated to allow the material to form around the product groups without strain. Cutting the wrapping material in the edge regions also allows the use of a flat material without the need of a forming shoulder.

Since a relatively low amount of strain is placed on the wrapping material during formation of the packages, of particular advantage, weaker wrapping materials may be used in the process and system of the present invention. Such materials may include plastic wrapping materials that have a lower caliper and/or plastic materials containing recycled plastics. For example, the wrapping materials may have a caliper or thickness of less than about 5 mils, such as less than about 2 mils and, in one embodiment, less than about 1 mil. In still other embodiments, paper wrappers, such as coated paper products, may be used in order to wrap the rolls of material.

In addition to using weaker wrapping materials, the wrapping materials used in the process of the present invention may contain various other perforations in addition to the perforation lines 42 without the material breaking during processing. Additional perforation lines may be incorporated into the wrapping material, for instance, to allow for later easy opening of the packages. Perforations used for opening the package may be parallel to the slit forming the first and second flaps or may be in line with the direction of the package such as shown at 51 in FIG. 2B. Perforation used to open the package may also be tied to graphics on the package indicating the location of these easy opening regions.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A process for packaging products in a wrapping material comprising:

conveying a product separated into groups having a length and a width down a process line;

unwinding a continuous wrapping material, the wrapping material having a first edge region, a second edge region, and a middle region, and wherein, at predetermined intervals, the wrapping material includes a first transverse slit in the first edge region opposite a second transverse slit in the second edge region, and the middle region of the wrapping material defines a perforation line in between the first transverse slit and the second transverse slit, wherein the perforation lines have a lenght less than the width of each group, wherein the wrapping material defines a plurality of first flaps located in the first edge region and a plurality of second flaps located in the second edge region, the first and second flaps being formed in between adjacent slits in the respective edge regions;

placing a first surface of each group adjacent to the wrapping material;

folding the first flaps and the second flaps over the groups, the folded flaps extending over a second surface located opposite the first surface;

severing the wrapping material in order to separate the wrapped groups into individual packages; and sealing a front end and a back end of the packages where the wrapping material has been severed.

2. A process as described in claim 1, where the wrapping process is a continuous process.

3. A process as defined in claim 1, wherein the wrapping material is servered along the perforation lines in order to separate the wrapped groups into individual packages.

4. A process as defined in claim 1, wherein the first transverse slits and the second transverse slits are formed into the wrapping material as the material is unwound.

5. A process as defined in claim 1, further comprising the step of sealing the first and second flaps together after being folded around the groups.

6. A process as defined in claim 1, wherein the product comprises a rolled tissue product.

7. A process as defined in claim 1, wherein each group comprises a single product.

8. A process as defined in claim 1, wherein each group comprises a plurality of products.

9. A process as defined in claim 1, wherein each group comprises a plurality of products in several layers.

10. A process as defined in claim 1, wherein the process line comprises an in-feed conveyor that separates the products into the groups.

11. A process as defined in claim 1, wherein the wrapping material comprises a plastic film, the plastic film having a caliper of less than about 0.5 mils.

12. A process as defined in claim 11, further comprising the step of sealing the first and second flaps together after being folded around the groups, the first and second flaps being sealed together by contacting the flaps with a heated gas.

13. A process as defined in claim 1, wherein the wrapping material comprises a plastic film, the plastic film containing recycled materials.

14. A process as defined in claim 1, wherein the wrapping material comprises a paper.

15. A process as defined in claim 14, wherein the paper wrapping material comprises a coated paper.

16. A process as defined in claim 1, wherein the wrapping material comprises a paper with pre-applied hot melt glue.

17. A process as defined in claim 1, wherein the groups comprise rolled products arranged in a plane parallel to the middle region of the wrapping material containing the perforation line and that have a centerline and an axis that is parallel to the direction of travel, the perforation lines having a length equal to the distance between the centerlines of the rolls located at an outermost edge of the groups.

18. A process as defined in claim 1, wherein the wrapping material includes further perforation lines that are configured to facilitate later opening of each package.

19. A process as defined in claim 1, wherein during the process the wrapping material is placed under a strain of less than about 50%.

20. A process as defined in claim 1, wherein the first surface comprises a top surface and wherein the first and second flaps are folded over the bottom surface of the groups.

21. A process as defined in claim 20, wherein the first and second flaps are held above each group by a suction force and later folded around the groups by a folding die.

22. A process as defined in claim 1, wherein the first surface comprises a bottom surface and wherein the first and second flaps are folded over the top surface of the groups.

23. A system for packaging products comprising:

a conveyor for conveying a product separated into groups having a length and a width;

an unwind device for unwinding a wrapping material, the wrapping material including a first edge region and a second edge region, the wrapping material including first flaps along the first edge region and second flaps along the second edge region, the unwind device being positioned to unwind the wrapping material adjacent to a first surface of the product groups being conveyed on the conveyor;

the wrapping material further comprising perforation lines located in a middle region of the wrapping material wherein the perforation lines have a length less than the width of each group;

at least one folding device positioned adjacent the product groups, the at least one folding device being configured to engage the first and second flaps and fold them over a second surface of the groups, the second surface being opposite the first surface;

a first sealing device for sealing the first and second flaps;

a severing apparatus configured to sever the wrapping material in between product groups after the first and second flaps have been folded thereby separating the groups into individual packages; and a second sealing device and a third sealing device for sealing a front end and a back end respectively of the packages where the wrapping material has been severed.

24. A system defined in claim 23, wherein the severing apparatus comprises a perforation breaking device configured to sever the wrapping material in between the product groups.

25. A system as defined in claim 24, wherein the perforation breaking device comprises a rotating plate.

26. A system as defined in claim 23, wherein the severing apparatus further comprises a first moving conveyor positioned downstream from a second moving conveyor, the first moving conveyor operating at a faster speed than the second moving conveyor in order to assist the perforation breaking device in severing the wrapping material.

27. A system as defined in claim 23, wherein the wrapping material is unwound over the product groups, the first surface of the groups comprising a top surface.

28. A system as defined in claim 27, further comprising at least one suction device for holding the flaps over the product groups prior to being engaged by the at least one folding device.

29. A system as defined in claim 28, wherein the suction device comprises a first vacuum belt in operative association with the first flaps and a second vacuum belt in operative association with the second flaps.

30. A system as defined in claim 23, wherein the at least one folding device comprises a plurality of folding dies.

31. A system as defined in claim 30, wherein the system comprises first and second folding dies for folding the first and second flaps respectively over each side of the product groups and third and fourth folding dies for folding the first and second flaps respectively over the second surface of the groups.

32. A system as defined in claim 30, wherein the second surface comprises a bottom surface of the groups and wherein the system further comprises a pair of lateral conveyors that receive the groups from the conveyor for conveying a product separated into groups and engage each side of the groups while the first and second flaps are folded over the bottom surface and sealed.

33. A system as defined in claim 23, further comprising at least one cutting and perforation device positioned to form a first transfer slit in the first edge region, a second transfer slit in the second edge region, and the perforation line in between the transverse slits in the middle region as the wrapping material is unwound by the unwind device.

34. A system as defined in claim 23, further comprising an in-feed section that receives the products and divides them into the groups.

35. A system as defined in claim 23, further comprising a retaining belt that holds the wrapping material against the first surface as the first and second flaps are folded.

36. A system as defined in claim 23, wherein the unwind device continuously unwinds a wrapping material as the product groups are being wrapped.

37. A system as defined in claim 23, wherein each group comprises at least two layers of products.

38. A system as defined in claim 23, wherein the product groups comprise rolled products arranged in a plane parallel to the middle region of the wrapping material containing the perforation line and that have a centerline and an axis that is parallel to the direction of travel, the perforation lines having a length equal to the distance between the centerlines of the rolls located at an outermost edge of in the groups.

39. A process for packaging products in a wrapping material comprising:

conveying a product separated into groups down a process line;

unwinding a continuous wrapping material adjacent the process line, the continuous wrapping material including a first edge region, a second edge region, and a middle region therebetween, the wrapping material being unwound above a top surface of the product groups;

forming into the wrapping material at periodic intervals as the wrapping material is being unwound a first transverse slit in the first edge region, a second transverse slit in the second edge region and a perforation line in the middle region, the perforation line being located in between the first transverse slit and the second transverse slit, the first transverse slits forming a plurality of first flaps in the first edge region and the second transverse slits forming a plurality of second flaps in the second edge region;

holding the first flaps and the second flaps above the product groups;

folding the first flaps and the second flaps around each side of the product groups, the folded flaps extending over a bottom surface of the groups;

sealing the first and second flaps together after being folded over the bottom surface;

severing the plastic film along the perforation lines in order to separate the groups into individual packages; and sealing a front end and a back end of the packages where the perforation lines have been severed.

40. A process as defined in claim 39, wherein the product comprises a rolled tissue product.

41. A process as defined in claim 39, wherein the wrapping material comprises a plastic film, the plastic film having a caliper of less than about 0.010".

42. A process as defined in claim 39, wherein the wrapping material comprises a plastic film, the plastic film containing recycled materials.

43. A process as defined in claim 39, wherein the wrapping material comprises a paper.

44. A process as defined in claim 39, wherein the groups have a length and a width and the perforation lines have a length less than the width of each group.

45. A process as defined in claim 39, wherein during the process the wrapping material is placed under a strain of less than about 50%.

46. A process as defined in claim 39, wherein the first and second flaps are held above each group by a suction force and later folded around the groups by a folding die.

47. A system for packaging products comprising:

a conveyor for conveying a product separated into groups;

an unwind device for unwinding a wrapping material, the wrapping material including a first edge region and a second edge region, the wrapping material including first flaps along the first edge region and second flaps along the second edge region, the wrapping material further comprising perforation lines located in a middle region of the wrapping material, the unwind device being positioned to unwind the wrapping material above a top surface of the product groups;

at least one suction device for holding the first flaps and the second flaps over the product groups;

a pair of opposing folding dies positioned adjacent each side of the product groups, the folding dies being configured to engage the first and second flaps and to fold them over each side of the groups;

at least a third folding die positioned adjacent a bottom surface of the product groups, the third folding die being configured to fold the first flap over the bottom surface of the groups;

a perforation breaking device configured to sever the wrapping material along the perforation lines after the first and second flaps have been folded over the side surfaces of the groups thereby separating the groups into individual packages;

a first sealing device for sealing the first and second flaps; and a second sealing device and a third sealing device for sealing a front end and a back end of the packages where the perforation lines have been severed.

48. A system as defined in claim 47, further comprising at least one cutting and perforation device positioned to form at periodic intervals a first transfer slit in the first edge region, a second transfer slit in the second edge region, and the perforation line in between the transverse slits in the middle region as the wrapping material is unwound by the unwind device.

49. A system as defined in claim 48, wherein the suction device comprises a first vacuum belt in operative association with the first flaps and a second vacuum belt in operative association with the second flaps.

50. A system as defined in claim 49, wherein the system further comprises a pair of lateral conveyors that receives the groups from the the conveyor for conveying a product separated into groups and engage each side of the groups while the first and second flaps are folded over the bottom surface and sealed.

51. A system as defined in claim 48, further comprising a retaining belt that holds the wrapping material against the top surface of the groups as the first and second flaps are folded.

* * * * *

UNITED STATES PATENT AND TRADEMARK OFFICE

CERTIFICATE OF CORRECTION

PATENT NO. : 7,174,697 B2
APPLICATION NO. : 11/017630
DATED : February 13, 2007
INVENTOR(S) : Frank S. Hada and Brian J. Gingras It is certified that error appears in the above-identified patent and that said Letters Patent is hereby corrected as shown below:

Column 14, line 10 reads "the groups from the the conveyor for conveying a product" should read --the groups from the conveyor for conveying a product--

Signed and Sealed this

Sixteenth Day of October, 2007

JON W. DUDAS
*Director of the United States Patent and Trademark Office*